US010803808B2

(12) United States Patent
Xu et al.

(10) Patent No.: US 10,803,808 B2
(45) Date of Patent: Oct. 13, 2020

(54) PIXEL DRIVING CIRCUIT AND METHOD FOR DRIVING THE SAME, DISPLAY PANEL, DISPLAY APPARATUS

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Yingsong Xu, Beijing (CN); Yangpeng Wang, Beijing (CN); Guoqiang Tang, Beijing (CN); Weinan Dai, Beijing (CN); Kuo Sun, Beijing (CN); Yuanyuan Chai, Beijing (CN)

(73) Assignees: CHENGDU BOE OPTOELECTRONICS TECHNOLOGY CO., LTD., Chengdu, Sichuan Province (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/532,881

(22) Filed: Aug. 6, 2019

(65) Prior Publication Data

US 2020/0273406 A1 Aug. 27, 2020

(30) Foreign Application Priority Data

Feb. 27, 2019 (CN) ..... 2019 1 0146412

(51) Int. Cl.
*G09G 3/3258* (2016.01)

(52) U.S. Cl.
CPC ... *G09G 3/3258* (2013.01); *G09G 2320/0233* (2013.01); *G09G 2320/043* (2013.01)

(58) Field of Classification Search
CPC ..... G09G 3/3233; G09G 3/3258
See application file for complete search history.

(56) References Cited

U.S. PATENT DOCUMENTS 7,812,796 B2 10/2010 Jung
2008/0122381 A1 5/2008 Jung
(Continued)

FOREIGN PATENT DOCUMENTS

CN 101097683 A 1/2008
CN 102682704 A 9/2012
(Continued)

OTHER PUBLICATIONS

First Chinese Office Action dated Mar. 2, 2020, received for corresponding Chinese Application No. 201910146412.9, 21 pages.

*Primary Examiner* — Gerald Johnson
(74) *Attorney, Agent, or Firm* — Kinney & Lange, P.A.

(57) ABSTRACT

A pixel driving circuit and a method for driving the same, a display panel, and a display apparatus are disclosed. The pixel driving circuit includes: a driving transistor, an organic light emitting diode, a light emitting control sub-circuit, a first scanning sub-circuit, a second scanning sub-circuit, a first storage sub-circuit, and a second storage sub-circuit. The light emitting control sub-circuit is configured to transmit a first voltage at a first voltage terminal to a second node under control of a light emitting control terminal. The first scanning sub-circuit is configured to cause a voltage at a first node to be equal to a voltage at the second node under control of a scanning signal terminal. The second scanning sub-circuit is configured to transmit a reference voltage at a reference voltage terminal to a third node under control of the scanning signal terminal. The first storage sub-circuit is configured to be charged or discharged under control of the second node and a data signal terminal. The second storage
(Continued)

sub-circuit is configured to be charged or discharged under control of the first node and the third node.

20 Claims, 7 Drawing Sheets

(56) References Cited

U.S. PATENT DOCUMENTS

| | | | | |
|---|---|---|---|---|
| 2017/0069262 | A1* | 3/2017 | Wu | G09G 3/3233 |
| 2019/0103054 | A1* | 4/2019 | Chang | G09G 3/3233 |

FOREIGN PATENT DOCUMENTS

| | | | |
|---|---|---|---|
| CN | 104409042 | A | 3/2015 |
| CN | 109119029 | A | 1/2019 |
| KR | 20090046053 | A | 5/2009 |

* cited by examiner

PIXEL DRIVING CIRCUIT AND METHOD FOR DRIVING THE SAME, DISPLAY PANEL, DISPLAY APPARATUS

CROSS-REFERENCE TO RELATED APPLICATION(S)

This application claims priority to the Chinese Patent Application No. 201910146412.9, filed on Feb. 27, 2019, which is incorporated herein by reference in its entirety.

TECHNICAL FIELD

The present disclosure relates to the field of display technology, and more particularly, to a pixel driving circuit and a method for driving the same, a display panel, and a display apparatus.

BACKGROUND

Organic Light Emitting Diode (OLED for short) displays have attracted much attention from the market due to their advantages such as self-luminance, a light weight, a low power consumption, a high contrast, a high color gamut, and capability of flexible display etc. Active-matrix OLEDs (AMOLEDs for short) have been widely used in various electronic devices comprising electronic products such as computers, mobile phones etc. due to advantages such as low driving voltages, long lifetime of light emitting components etc.

Due to the difference in manufacturing process and long-term use, a threshold voltage of each driving transistor in a pixel driving circuit of an AMOLED display panel may drift, which causes problems such as uneven brightness of a display picture etc.

SUMMARY

Embodiments of the present disclosure provide a pixel driving circuit and a method for driving the same, a display panel, and a display apparatus.

According to a first aspect of the present disclosure, there is provided a pixel driving circuit, comprising: a driving transistor, an organic light emitting diode, a light emitting control sub-circuit, a first scanning sub-circuit, a second scanning sub-circuit, a first storage sub-circuit, and a second storage sub-circuit, wherein a gate of the driving transistor is electrically connected to a first node, a first electrode of the driving transistor is electrically connected to a second node, and a second electrode of the driving transistor is electrically connected to a third node;

an anode of the organic light emitting diode is electrically connected to the third node, and a cathode of the organic light emitting diode is electrically connected to a second voltage terminal;

the light emitting control sub-circuit is electrically connected to a light emitting control terminal, a first voltage terminal, and the second node, and is configured to transmit a first voltage at the first voltage terminal to the second node under control of a voltage at the light emitting control terminal;

the first scanning sub-circuit is electrically connected to a scanning signal terminal, the first node, and the second node, and is configured to cause a voltage at the first node to be equal to a voltage at the second node under control of a voltage at the scanning signal terminal;

the second scanning sub-circuit is electrically connected to the scanning signal terminal, the third node, and a reference voltage terminal, and is configured to transmit a reference voltage at the reference voltage terminal to the third node under control of the voltage at the scanning signal terminal;

the first storage sub-circuit is electrically connected to the second node and a data signal terminal, and is configured to be charged or discharged under control of the voltage at the second node and a voltage at the data signal terminal; and the second storage sub-circuit is electrically connected to the first node and the third node, and is configured to be charged or discharged under control of the voltage at the first node and a voltage at the third node.

In some embodiments, the first scanning sub-circuit comprises a first transistor, wherein a gate of the first transistor is electrically connected to the scanning signal terminal, a first electrode of the first transistor is electrically connected to the first node, and a second electrode of the first transistor is electrically connected to the second node.

In some embodiments, the second scanning sub-circuit comprises a second transistor, wherein a gate of the second transistor is electrically connected to the scanning signal terminal, a first electrode of the second transistor is electrically connected to the third node, and a second electrode of the second transistor is electrically connected to the reference voltage terminal.

In some embodiments, the light emitting control sub-circuit comprises a third transistor, wherein a gate of the third transistor is electrically connected to the light emitting control terminal, a first electrode of the third transistor is electrically connected to the first voltage terminal, and a second electrode of the third transistor is electrically connected to the second node.

In some embodiments, the first storage sub-circuit comprises a first capacitor, wherein a first terminal of the first capacitor is electrically connected to the second node, and a second terminal of the first capacitor is electrically connected to the data signal terminal.

In some embodiments, the second storage sub-circuit comprises a second capacitor, wherein a first terminal of the second capacitor is electrically connected to the first node, and a second terminal of the second capacitor is electrically connected to the third node.

In some embodiments, the first storage sub-circuit comprises a first capacitor, wherein a first terminal of the first capacitor is electrically connected to the second node, and a second terminal of the first capacitor is electrically connected to the data signal terminal.

In some embodiments, the second storage sub-circuit comprises a second capacitor, wherein a first terminal of the second capacitor is electrically connected to the first node, and a second terminal of the second capacitor is electrically connected to the third node.

According to a second aspect of the present disclosure, there is further provided a display panel, comprising the pixel driving circuit according to the first aspect.

According to a third aspect of the present disclosure, there is further provided a display apparatus, comprising the display panel according to the second aspect.

According to a fourth aspect of the present disclosure, there is further provided a method for driving the pixel driving circuit according to the first aspect, comprising:

in a reset phase, inputting a reference voltage to the data signal terminal and the reference voltage terminal respectively, inputting a turn-on voltage to the light emitting control terminal, and inputting a scanning signal to the scanning signal terminal;

in a programming phase, continuously inputting the reference voltage to the data signal terminal and the reference voltage terminal, inputting a turn-off voltage to the light emitting control terminal, and continuously inputting the scanning signal to the scanning signal terminal;

in a pixel data writing phase, continuously inputting the reference voltage to the reference voltage terminal, inputting a pixel data voltage to the data signal terminal, continuously inputting the turn-off voltage to the light emitting control terminal, and continuously inputting the scanning signal to the scanning signal terminal; and in a light emitting phase, inputting the reference voltage to the data signal terminal and the reference voltage terminal respectively, and inputting the turn-on voltage to the light emitting control terminal.

In some embodiments, a second voltage V2 satisfies:

$$V2 = \frac{C1}{(C1 + C2)}(Vdata - Vref) + Vref + Vth,$$

where Vdata is the pixel data voltage, Vref is the reference voltage, C1 is first capacitance, C2 is second capacitance, and Vth is a threshold voltage of the driving transistor.

BRIEF DESCRIPTION OF THE ACCOMPANYING DRAWINGS

In order to more clearly illustrate the technical solutions in the embodiments of the present disclosure or the related art, the accompanying drawings to be used in the description of the embodiments or the related art will be briefly described below. Obviously, the accompanying drawings in the following description are merely some embodiments of the present disclosure, and other accompanying drawings may be obtained by those of ordinary skill in the art according to these accompanying drawings without any creative work.

Figure 4A:
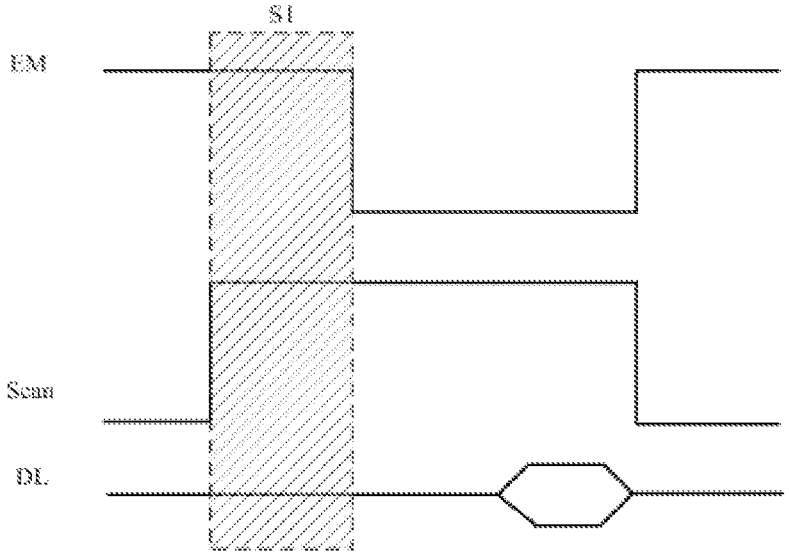
Figure 4B:
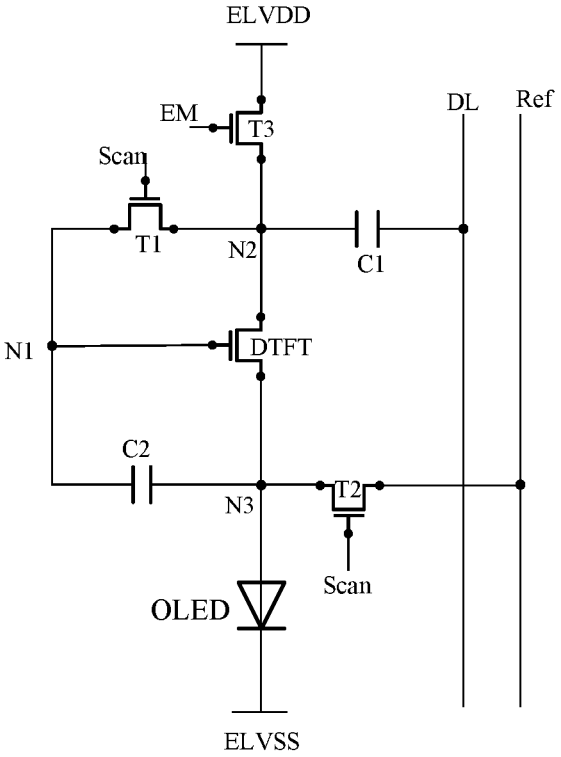
Figure 5A:
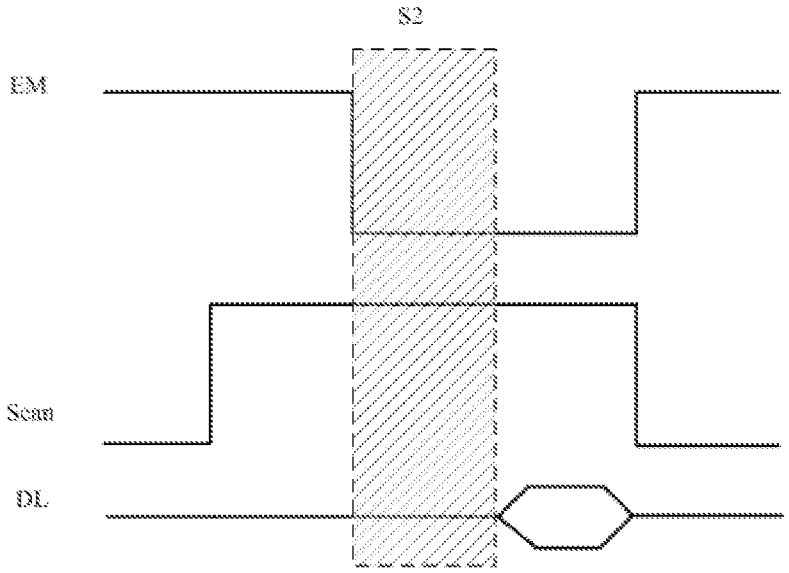
Figure 5B:
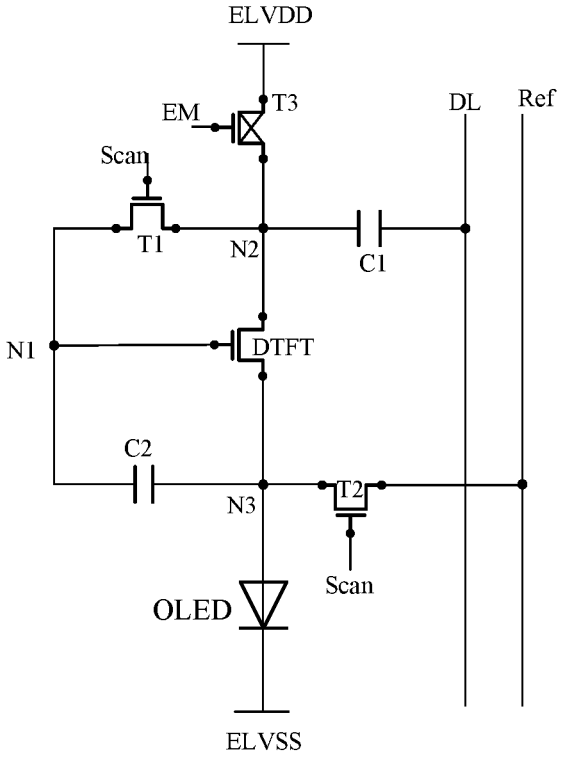
Figure 6A:
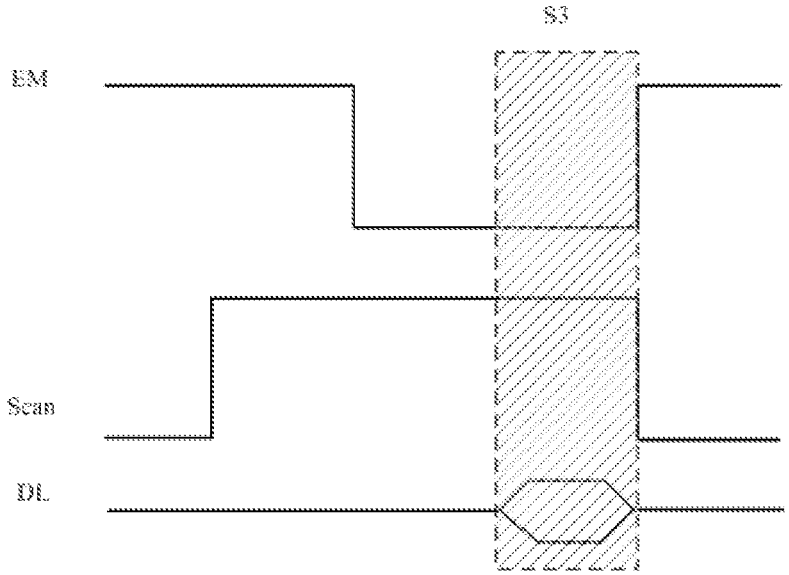
Figure 6B:
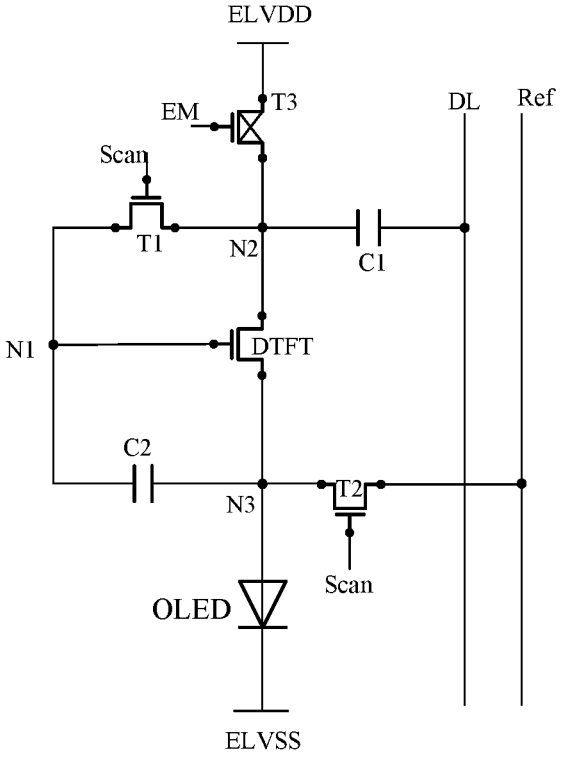
Figure 7A:
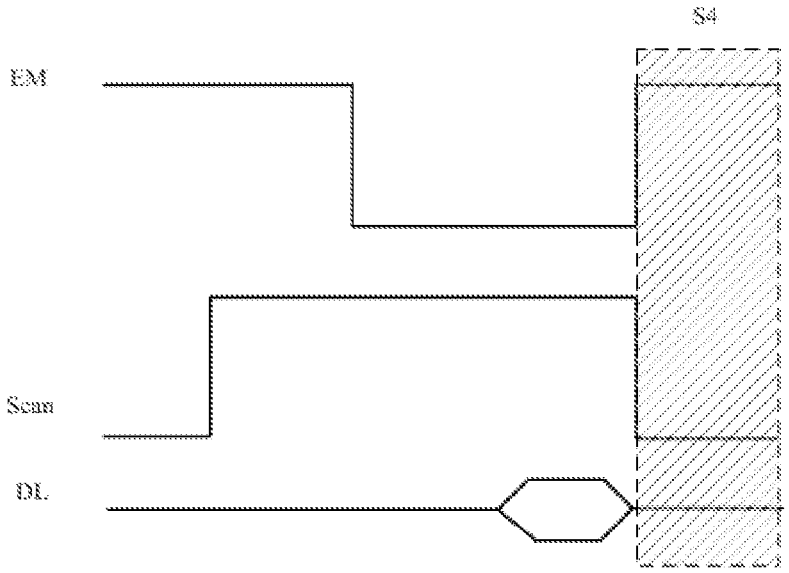
Figure 7B:
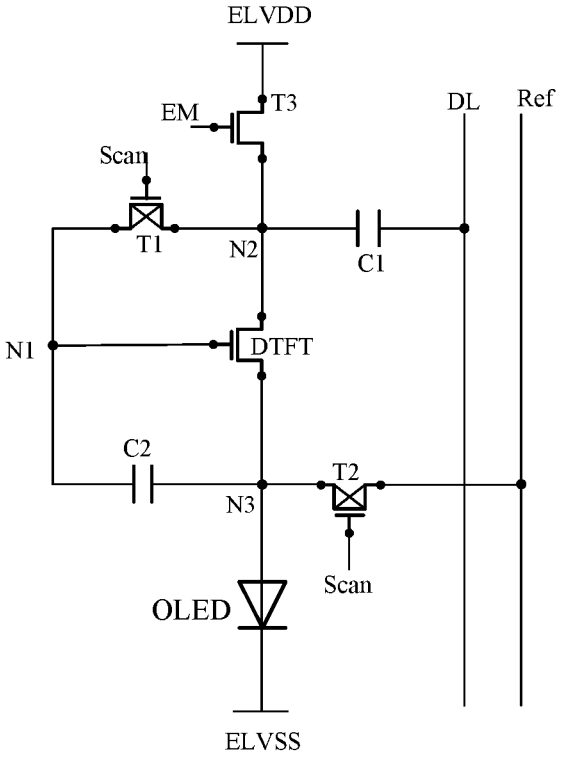

FIG. 4*a* is a schematic diagram of driving timing control of a pixel driving circuit comprising a phase S1 according to an embodiment of the present disclosure;

FIG. 4*b* is a schematic diagram of the pixel driving circuit in the phase S1;

FIG. 5*a* is a schematic diagram of driving timing control of a pixel driving circuit comprising a phase S2 according to an embodiment of the present disclosure;

FIG. 5*b* is a schematic diagram of the pixel driving circuit in the phase S2;

FIG. 6*a* is a schematic diagram of driving timing control of a pixel driving circuit comprising a phase S3 according to an embodiment of the present disclosure;

FIG. 6*b* is a schematic diagram of the pixel driving circuit in the phase S3;

FIG. 7*a* is a schematic diagram of driving timing control of a pixel driving circuit comprising a phase S4 according to an embodiment of the present disclosure; and FIG. 7*b* is a schematic diagram of the pixel driving circuit in the phase S4.

DETAILED DESCRIPTION

The technical solutions according to the embodiments of the present disclosure will be clearly and completely described below in conjunction with the accompanying drawings of the embodiments of the present disclosure. It is obvious that the embodiments described are merely a part of the embodiments of the present disclosure, instead of all the embodiments. All other embodiments obtained by those of ordinary skill in the art based on the embodiments of the present disclosure without any creative work are within the protection scope of the present disclosure.

Unless otherwise defined, technical terms or scientific terms used in the embodiments of the present disclosure should be interpreted in the ordinary sense for those of ordinary skill in the art to which the present disclosure belongs. The words such as "first," "second," etc. used in the embodiments of the present disclosure do not mean any order, quantity or importance, but merely serve to distinguish different constituent parts. The word such as "including" or "comprising" etc. means that an element or item preceding the word covers elements or items which appear after the word and their equivalents, but does not exclude other elements or items. The word "connected" or "connecting" etc. is not limited to physical or mechanical connections but may comprise electrical connections, regardless of direct connections or indirect connections. "Upper", "lower", "left", "right", etc. are only used to indicate a relative positional relationship, and after an absolute position of an object which is described changes, the relative positional relationship may also change accordingly.

It may be understood by those skilled in the field of display that in a pixel driving circuit of an organic light emitting diode display panel (i.e., an OLED display panel), magnitude of current flowing through an organic light emitting diode OLED is controlled by controlling a gate-source voltage of a driving transistor, so as to control brightness of the organic light emitting diode.

As an example, for some 2T1C-type pixel driving circuits (i.e., comprising two transistors and one capacitor), current I flowing through an organic light emitting diode satisfies the following formula $I=k(Vdd-Vdata-Vth)^2$, where k is an intrinsic conductive factor of a driving transistor; Vdd is a power supply voltage; Vdata is a pixel data voltage; Vth is a threshold voltage of the driving transistor; and k and Vdd are both fixed values. It may be seen that magnitude of the threshold voltage Vth directly affects the current flowing through the organic light emitting diode (that is, brightness of the organic light emitting diode). Therefore, for a display panel, threshold voltages of driving transistors in the respective pixel driving circuits are not consistent due to the difference in manufacturing process and the long-term use, and problems such as uneven brightness of a display picture etc. may occur.

Figure 1:
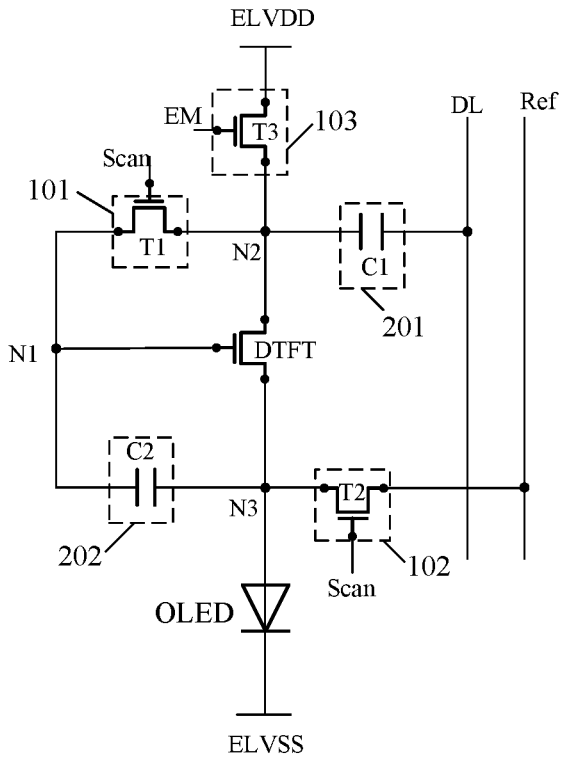
FIG. 1 is a schematic structural diagram of a pixel driving circuit according to an embodiment of the present disclosure.

Based thereon, the embodiments of the present disclosure provide a pixel driving circuit. As shown in FIG. 1, in addition to a driving transistor DTFT and an organic light emitting diode OLED, the pixel driving circuit further comprises: a first scanning sub-circuit 101, a second scanning sub-circuit 102, a light emitting control sub-circuit 103, a first storage sub-circuit 201, and a second storage sub-circuit 202.

Here, the driving transistor DTFT has a gate connected to a first node N1, a first electrode connected to a second node N2, and a second electrode connected to a third node N3.

The organic light emitting diode OLED has an anode connected to the third node N3, and a cathode connected to a second voltage terminal ELVSS.

The first scanning sub-circuit 101 is connected to a scanning signal terminal Scan (that is, a scanning signal line), the first node N1, and the second node N2. 'The first scanning sub-circuit 101 is configured to cause the first node N1 and the second node N2 to have the same voltage under control of a voltage at the scanning signal terminal Scan.

The second scanning sub-circuit 102 is connected to the scanning signal terminal Scan, the third node N3, and a reference voltage terminal Ref. The second scanning sub-circuit 102 is configured to transmit a reference voltage at the reference voltage terminal Ref to the third node N3 under control of the voltage at the scanning signal terminal Scan.

The light emitting control sub-circuit 103 is connected to a light emitting control terminal EM, a first voltage terminal ELVDD, and the second node N2. The light emitting control sub-circuit 103 is configured to transmit a first voltage at the first voltage terminal ELVDD to the second node N2 under control of a voltage at the light emitting control terminal EM.

The first storage sub-circuit 201 is connected to the second node N2 and a data signal terminal DL (i.e., a data signal line). The first storage sub-circuit 201 is configured to perform charging and discharging under control of voltages at the second node N2 and the data signal terminal DL.

The second storage sub-circuit 202 is connected to the first node N1 and the third node N3. The second storage sub-circuit 202 is configured to be charged and discharged under control of voltages at the first node N1 and the third node N3.

In summary, with the pixel driving circuit according to the present disclosure, under control of each signal terminal, the pixel data voltage may be written into the gate of the driving transistor in a coupled manner through the storage sub-circuits (comprising the first storage sub-circuit and the second storage sub-circuit), and the threshold voltage of the driving transistor is compensated, so that the current flowing through the organic light emitting diode is independent of the threshold voltage of the driving transistor, thereby solving the problems such as uneven brightness of a display picture etc. due to inconsistent threshold voltages of the respective driving transistors in the display panel.

On the other hand, with the pixel driving circuit according to the present disclosure, it may be ensured that the driving current for driving the organic light emitting diode is independent of the voltages at the power supply voltage terminals (the first voltage terminal and the second voltage terminal), thereby avoiding uneven brightness due to IR voltage drop or current resistance voltage drop for pixel driving circuits at a near IC terminal and a far IC terminal in the display panel.

Further, a specific circuit arrangement of each of the above sub-circuits will be further described below.

In some embodiments, as shown in FIG. 1, the first scanning sub-circuit 101 may comprise a first transistor T1. Here, the first transistor T1 has a gate connected to the scanning signal terminal Scan, a first electrode connected to the first node N1, and a second electrode connected to the second node N2.

In some embodiments, as shown in FIG. 1, the second scanning sub-circuit 102 comprises a second transistor T2. Here, the second transistor T2 has a gate connected to the scanning signal terminal Scan, a first electrode connected to the third node N3, and a second electrode connected to the reference voltage terminal Ref.

In some embodiments, as shown in FIG. 1, the light emitting control sub-circuit 103 comprises a third transistor T3. Here, the third transistor T3 has a gate connected to the light emitting control terminal EM, a first electrode connected to the first voltage terminal ELVDD, and a second electrode connected to the second node N2.

In some embodiments, as shown in FIG. 1, the first storage sub-circuit 201 comprises a first capacitor C11 Here, the first capacitor C1 has a first terminal connected to the second node N2, and a second terminal connected to the data signal terminal DL.

In some embodiments, as shown in FIG. 1, the second storage sub-circuit 202 comprises a second capacitor C2. Here, the second capacitor C2 has a first terminal connected to the first node N1, and a second terminal connected to the third node N3.

Figure 2:
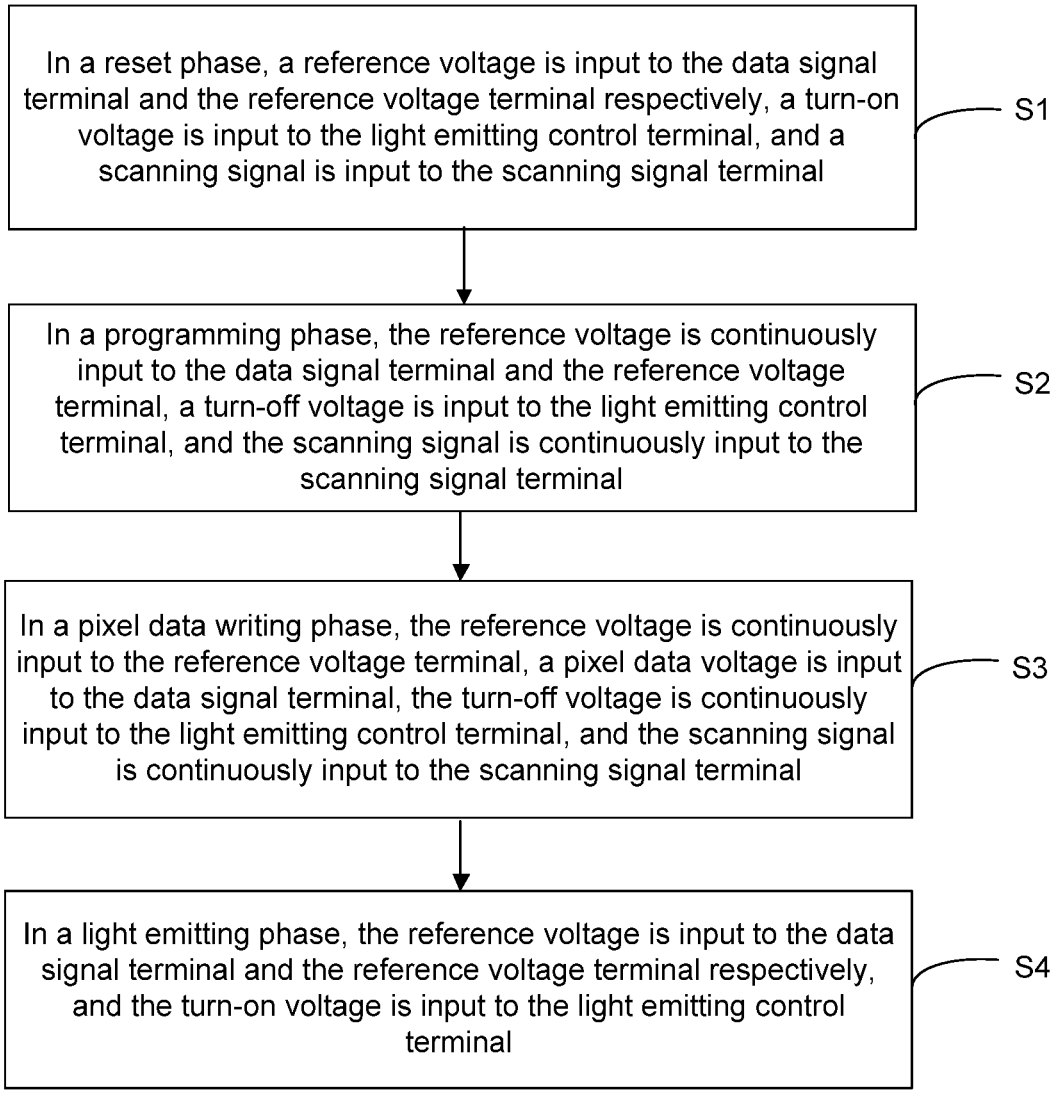
FIG. 2 is a schematic flowchart of a method for driving a pixel driving circuit according to an embodiment of the present disclosure.
Figure 3:
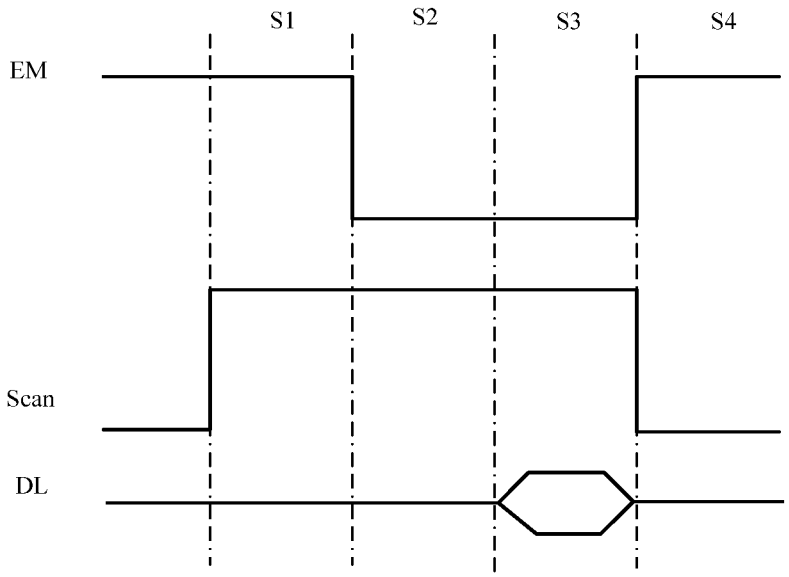
FIG. 3 is a schematic diagram of driving timing control of a pixel driving circuit according to an embodiment of the present disclosure.

The embodiments of the present disclosure further provide a method for driving the pixel driving circuit described above, which will be further described below with reference to FIGS. 2 and 3.

Specifically, the method comprises a reset phase S1, a programming phase S2, a pixel data writing phase S3, and a light emitting phase S4.

Specifically, in the reset phase S1, a reference voltage Vref is input to the data signal terminal DL and the reference voltage terminal Ref respectively; a turn-on voltage is input to the light emitting control terminal EM, so that the light emitting control sub-circuit 103 is turned on; a scanning signal is input to the scanning signal terminal Scan, so that the first scanning sub-circuit 101 and the second scanning sub-circuit 102 are turned on, a voltage (Vdd) at the first voltage terminal ELVDD is output to the first node N1 and the second node N2, and a reference voltage Vref at the reference voltage terminal Ref is output to the third node N3; and at the same time, the first storage sub-circuit 201 and the second storage sub-circuit 202 are charged.

By way of example, operating states of the respective transistors and capacitors of the pixel driving circuit in the reset phase S1 will be further described below with reference to FIGS. 4*a* and 4*b*.

The first transistor T1 and the second transistor T2 are turned on under control of the scanning signal input at the scanning signal terminal Scan, and the third transistor T3 is turned on under control of the turn-on voltage input at the light emitting control terminal EM, so that the voltage (Vdd) at the first voltage terminal ELVDD is output to the first node N1 and the second node N2; and the reference voltage Vref at the reference voltage terminal Ref is output to the third node N3.

In addition, the first capacitor C1 and the second capacitor C2 are charged by voltage differences across the first capacitor C1 and the second capacitor C2 respectively.

It should be illustrated that, in practice, it should be ensured that a difference between a voltage (Vref) at the third node N3 and a voltage (Vss) at the second voltage terminal ELVSS should be less than a minimum light emitting voltage $V_{OLED}$ of the organic light emitting diode OLED, that is, $Vref-Vss \leq V_{OLED}$, to ensure that in the reset phase S1, the organic light emitting diode OLED does not emit light, thereby achieving the purpose of improving display contrast.

Next, in the programming phase S2, the reference voltage Vref is continuously input to the data signal terminal DL and the reference voltage terminal Ref; a turn-off voltage is input to the light emitting control terminal EM, and the light emitting control sub-circuit 103 is turned off; and the scanning signal is continuously input to the scanning signal terminal Scan, the first scanning sub-circuit 101 and the second scanning sub-circuit 102 are maintained to be turned on, and potentials at the first node N1 and the second node N2 are electrically leaked through the driving transistor DTFT from the voltage Vdd at the first voltage terminal ELVDD to a first voltage V1, wherein the first voltage V1 is equal to a sum of the reference voltage Vref and the threshold voltage Vth of the driving transistor DTFT, that is, V1=Vref+Vth.

By way of example, operating states of the respective transistors and capacitors of the pixel driving circuit in the programming phase S2 will be further described below with reference to FIGS. 5*a* and 5*b*.

The third transistor T3 is turned off under control of the turn-off voltage input at the light emitting control terminal EM, and the first transistor T1 and the second transistor T2 are maintained to be turned on under control of the scanning signal input at the scanning signal terminal Scan, so that the potentials at the first node N1 and the second node N2 are electrically leaked through the driving transistor DTFT from the voltage Vdd at the first voltage terminal ELVDD to the first voltage V1, wherein V1=Vref+Vth, and the third node N3 is maintained at the reference voltage Vref.

In addition, the first capacitor C1 and the second capacitor C2 are charged by voltage differences across the first capacitor C1 and the second capacitor C2 respectively.

Of course, it may be understood that, in the programming phase S2, the driving transistor DTFT is in a saturation region to perform electric leakage to maintain the first node N1 and the second node N2 at the first voltage V1=Vref+Vth.

Then, in the pixel data writing phase S3, the reference voltage Vref is continuously input to the reference voltage terminal Ref; a pixel data voltage Vdata is input to the data signal terminal DL; the turn-off voltage is continuously input to the light emitting control terminal EM, and the light emitting control sub-circuit 103 is maintained to be turned off; and the scanning signal is continuously input to the scanning signal terminal Scan, the first scanning sub-circuit 101 and the second scanning sub-circuit 102 are maintained to be turned on, the potentials at the first node N1 and the second node N2 rise from the first voltage V1 to a second voltage V2, and the second voltage V2 is positively correlated with the pixel data voltage Vdata, that is V2−V1=K·Vdata+b, where b is a known parameter and K is a positive number.

By way of example, operating states of the respective transistors and capacitors of the pixel driving circuit in the pixel data writing phase S3 will be further described below with reference to FIGS. 6*a* and 6*b*.

The third transistor T3 is maintained to be turned off under control of the turn-off voltage input at the light emitting control terminal EM, and the first transistor T1 and the second transistor T2 are maintained to be turned on under control of the scanning signal continuously input at the scanning signal terminal Scan; the third node N3 is maintained at the reference voltage Vref; and the voltage input at the data signal terminal DL is adjusted from the reference voltage Vref in the programming phase S2 to the pixel data voltage Vdata in the pixel data writing phase S3. In this case, charges stored on the first capacitor C1 and the second capacitor C2 are redistributed, so that the potentials at the first node N1 and the second node N2 rise from the first voltage V1=Vref+Vth to the second voltage $$V2 = \frac{C1}{(C1 + C2)}(Vdata - Vref) + Vref + Vth.$$

Finally, in the light emitting phase S4, the reference voltage Vref is input to the data signal terminal DL and the reference voltage terminal Ref respectively; the turn-on voltage is input to the light emitting control terminal EM, and the light emitting control sub-circuit 103 is turned on; and inputting of the scanning signal to the scanning signal terminal Scan is stopped, the first scanning sub-circuit 101 and the second scanning sub-circuit 102 are turned off, the potential at the first node N1 is maintained at the second voltage V2, and the organic light emitting diode OLED is driven by the driving transistor DTFT to emit light.

By way of example, operating states of the respective transistors and capacitors of the pixel driving circuit in the pixel data writing phase S3 will be further described below with reference to FIGS. 7*a* and 7*b*.

The third transistor T3 is turned on under control of the turn-on voltage input at the light emitting control terminal EM; inputting of the scanning signal to the scanning signal terminal Scan is stopped, the first transistor T1 and the second transistor T2 are turned off, and the voltage input at the data signal terminal DL is adjusted from the pixel data voltage Vdata in the pixel data writing phase S3 to the reference voltage Vref; and the first node N1 and the third node N3 are maintained at the potentials in the pixel data writing phase S3 due to discharging of the first capacitor C1 and the second capacitor C2, that is, the potential at the first node N1 is maintained at the second voltage V2, and the potential at the third node N3 is maintained at the reference voltage Vref. In this case, current for driving the organic light emitting diode OLED to emit light is $$I = k(Vgs - Vth)^2 = k\left[\frac{C1}{(C1 + C2)}(Vdata - Vref)\right]^2.$$

It may be understood here that in practice, Vgs-Vth>0 should be satisfied, and therefore, it needs to be ensured that Vdata-Vref>0.

In this case, it may be known by comparing the driving current $$I = k\left[\frac{C1}{(C1 + C2)}(Vdata - Vref)\right]^2$$

when the organic light emitting diode is driven by the pixel driving circuit according to the present disclosure to emit light with driving current $I=k\,(Vdd-Vdata-Vth)^2$ when the organic light emitting diode is driven by the pixel driving circuit in the related art that:

- in one aspect, the threshold voltage Vth of the driving transistor is compensated (cancelled), thereby avoiding uneven brightness of a display picture due to inconsistent threshold voltages of the respective driving transistors in the display panel;
- in another aspect, the driving current in the present disclosure is independent of the voltages at the power supply voltage terminals (the first voltage terminal and the second voltage terminal), thereby avoiding the problem of uneven brightness due to IR voltage drop or current resistance voltage drop for pixel driving circuits at a near IC terminal and a far IC terminal in the display panel; and in a further aspect, the pixel driving circuit according to the present disclosure adopts a 4T2C-type circuit structure (i.e., four transistors and two capacitors), so that a pixel data signal is written through capacitive coupling under the premise of using fewer transistors, which achieves the purposes of simplifying the circuit and reducing control timing, thereby being more advantageous to achieve a high Pixels Per inch (PPI) display apparatus.

The embodiments of the present disclosure further provide a display panel comprising the pixel driving circuit described above.

The embodiments of the present disclosure further provide a display apparatus comprising the display panel described above.

The above display panel and the display apparatus each comprise the pixel driving circuit as described above, and have the same structure and advantageous effects as those of the pixel driving circuit according to the above embodiments. Since the structure and advantageous effects of the pixel driving circuit have been described in detail in the above embodiments, details thereof will not be described herein again.

It should be illustrated that, in the embodiments of the present disclosure, the display apparatus may be any product or component having a display function, such as an electronic paper, a mobile phone, a tablet computer, a television, a display, a notebook computer, a digital photo frame, a navigator, etc.

The above description is only specific embodiments of the present disclosure, but the protection scope of the present disclosure is not limited thereto. Changes or substitutions which may easily be reached by any skilled in the art within the technical scope of the present disclosure should fall within the protection scope of the present disclosure. Therefore, the protection scope of the present disclosure should be determined by the protection scope of the claims.

We claim:

1. A pixel driving circuit, comprising: a driving transistor, an organic light emitting diode, a light emitting control sub-circuit, a first scanning sub-circuit, a second scanning sub-circuit, a first storage sub-circuit, and a second storage sub-circuit, wherein:

a gate of the driving transistor is electrically connected to a first node, a first electrode of the driving transistor is electrically connected to a second node, and a second electrode of the driving transistor is electrically connected to a third node;

an anode of the organic light emitting diode is electrically connected to the third node, and a cathode of the organic light emitting diode is electrically connected to a second voltage terminal;

the light emitting control sub-circuit is electrically connected to a light emitting control terminal, a first voltage terminal, and the second node, and is configured to transmit a first voltage at the first voltage terminal to the second node under control of a voltage at the light emitting control terminal;

the first scanning sub-circuit is electrically connected to a scanning signal terminal, the first node, and the second node, and is configured to cause a voltage at the first node to be equal to a voltage at the second node under control of a voltage at the scanning signal terminal;

the second scanning sub-circuit is electrically connected to the scanning signal terminal, the third node, and a reference voltage terminal, and is configured to transmit a reference voltage at the reference voltage terminal to the third node under control of the voltage at the scanning signal terminal;

the first storage sub-circuit is electrically connected to the second node and a data signal terminal, and is configured to be charged or discharged under control of the voltage at the second node and a voltage at the data signal terminal; and the second storage sub-circuit is electrically connected to the first node and the third node, and is configured to be charged or discharged under control of the voltage at the first node and a voltage at the third node.

2. The pixel driving circuit according to claim 1, wherein the first scanning sub-circuit comprises a first transistor, wherein:

a gate of the first transistor is electrically connected to the scanning signal terminal, a first electrode of the first transistor is electrically connected to the first node, and a second electrode of the first transistor is electrically connected to the second node.

3. The pixel driving circuit according to claim 2, wherein the second scanning sub-circuit comprises a second transistor, wherein:

a gate of the second transistor is electrically connected to the scanning signal terminal, a first electrode of the second transistor is electrically connected to the third node, and a second electrode of the second transistor is electrically connected to the reference voltage terminal.

4. The pixel driving circuit according to claim 3, wherein the light emitting control sub-circuit comprises a third transistor, wherein:

a gate of the third transistor is electrically connected to the light emitting control terminal, a first electrode of the third transistor is electrically connected to the first voltage terminal, and a second electrode of the third transistor is electrically connected to the second node.

5. The pixel driving circuit according to claim 1, wherein the first storage sub-circuit comprises a first capacitor, wherein:

a first terminal of the first capacitor is electrically connected to the second node, and a second terminal of the first capacitor is electrically connected to the data signal terminal.

6. The pixel driving circuit according to claim 5, wherein the second storage sub-circuit comprises a second capacitor, wherein:

a first terminal of the second capacitor is electrically connected to the first node, and a second terminal of the second capacitor is electrically connected to the third node.

7. The pixel driving circuit according to claim 4, wherein the first storage sub-circuit comprises a first capacitor, wherein:

a first terminal of the first capacitor is electrically connected to the second node, and a second terminal of the first capacitor is electrically connected to the data signal terminal.

8. The pixel driving circuit according to claim 7, wherein the second storage sub-circuit comprises a second capacitor, wherein:

a first terminal of the second capacitor is electrically connected to the first node, and a second terminal of the second capacitor is electrically connected to the third node.

9. A display panel, comprising the pixel driving circuit according to claim 1.

10. A display panel, comprising the pixel driving circuit according to claim 2.

11. A display panel, comprising the pixel driving circuit according to claim 3.

12. A display panel, comprising the pixel driving circuit according to claim 4.

13. A display panel, comprising the pixel driving circuit according to claim 6.

14. A display panel, comprising the pixel driving circuit according to claim 8.

15. A display apparatus, comprising the display panel according to claim 9.

16. A method for driving the pixel driving circuit according to claim 1, comprising:

in a reset phase, inputting a reference voltage to the data signal terminal and the reference voltage terminal, respectively, inputting a turn-on voltage to the light emitting control terminal, and inputting a scanning signal to the scanning signal terminal;

in a programming phase, continuously inputting the reference voltage to the data signal terminal and the reference voltage terminal, inputting a turn-off voltage to the light emitting control terminal, and continuously inputting the scanning signal to the scanning signal terminal;

in a pixel data writing phase, continuously inputting the reference voltage to the reference voltage terminal, inputting a pixel data voltage to the data signal terminal, continuously inputting the turn-off voltage to the light emitting control terminal, and continuously inputting the scanning signal to the scanning signal terminal; and in a light emitting phase, inputting the reference voltage to the data signal terminal and the reference voltage terminal respectively, and inputting the turn-on voltage to the light emitting control terminal.

17. A method for driving the pixel driving circuit according to claim 6, comprising:

in a reset phase, inputting a reference voltage to the data signal terminal and the reference voltage terminal respectively, inputting a turn-on voltage to the light emitting control terminal, and inputting a scanning signal to the scanning signal terminal;

in a programming phase, continuously inputting the reference voltage to the data signal terminal and the reference voltage terminal, inputting a turn-off voltage to the light emitting control terminal, and continuously inputting the scanning signal to the scanning signal terminal;

in a pixel data writing phase, continuously inputting the reference voltage to the reference voltage terminal, inputting a pixel data voltage to the data signal terminal, continuously inputting the turn-off voltage to the light emitting control terminal, and continuously inputting the scanning signal to the scanning signal terminal; and in a light emitting phase, inputting the reference voltage to the data signal terminal and the reference voltage terminal respectively, and inputting the turn-on voltage to the light emitting control terminal.

18. The method according to claim 17, wherein a second voltage V2 satisfies:

$$V2 = \frac{C1}{(C1 + C2)}(Vdata - Vref) + Vref + Vth,$$

where Vdata is the pixel data voltage, Vref is the reference voltage, C1 is a first capacitance of the first capacitor, C2 is second capacitance of the second capacitor, and Vth is a threshold voltage of the driving transistor.

19. A method for driving the pixel driving circuit according to claim 8, comprising:

in a reset phase, inputting a reference voltage to the data signal terminal and the reference voltage terminal respectively, inputting a turn-on voltage to the light emitting control terminal, and inputting a scanning signal to the scanning signal terminal;

in a programming phase, continuously inputting the reference voltage to the data signal terminal and the reference voltage terminal, inputting a turn-off voltage to the light emitting control terminal, and continuously inputting the scanning signal to the scanning signal terminal;

in a pixel data writing phase, continuously inputting the reference voltage to the reference voltage terminal, inputting a pixel data voltage to the data signal terminal, continuously inputting the turn-off voltage to the light emitting control terminal, and continuously inputting the scanning signal to the scanning signal terminal; and in a light emitting phase, inputting the reference voltage to the data signal terminal and the reference voltage terminal respectively, and inputting the turn-on voltage to the light emitting control terminal.

20. The method according to claim 19, wherein a second voltage V2 satisfies:

$$V2 = \frac{C1}{(C1 + C2)}(Vdata - Vref) + Vref + Vth,$$

where Vdata is the pixel data voltage, Vref is the reference voltage, C1 is a first capacitance of the first capacitor, C2 is second capacitance of the second capacitor, and Vth is a threshold voltage of the driving transistor.

* * * * *